US005438921A

United States Patent [19]

Hasegawa

[11] Patent Number: 5,438,921

[45] Date of Patent: Aug. 8, 1995

[54] STENCIL PRINTING DEVICE HAVING AN INK MIXING UNIT

[75] Inventor: Takanori Hasegawa, Tokyo, Japan

[73] Assignee: Riso Kagaku Corporation, Tokyo, Japan

[21] Appl. No.: 293,590

[22] Filed: Aug. 22, 1994

[30] Foreign Application Priority Data

Aug. 24, 1993 [JP] Japan ..... 5-209416

[51] Int. Cl.[6] ..... B41F 15/40; B41L 13/04; B41L 13/18

[52] U.S. Cl. ..... 101/116; 101/119; 101/120; 101/123; 101/114

[58] Field of Search ..... 101/116, 119, 120, 123, 101/350, 364, 148, 147, 114

[56] References Cited

U.S. PATENT DOCUMENTS

| | | | |
|---|---|---|---|
| 3,779,161 | 12/1973 | Tatebe | 101/123 |
| 3,780,651 | 12/1973 | Black et al. | 101/115 |
| 3,785,285 | 1/1974 | Chambon | 101/148 |
| 4,140,056 | 2/1979 | Mabrouk | 101/148 |
| 4,385,558 | 5/1983 | Takahashi et al. | 101/363 |

FOREIGN PATENT DOCUMENTS 4215923 11/1992 Germany .

2240950 8/1991 United Kingdom .

*Primary Examiner*—Edgar S. Burr
*Assistant Examiner*—Lynn D. Hendrickson
*Attorney, Agent, or Firm*—Dickstein, Shapiro & Morin

[57] ABSTRACT

The stencil printing device of the present invention comprises a mixing unit for receiving the first liquid from the first liquid storage container and the second liquid from the second liquid storage container, and producing printing ink by mixing the two liquids, a printing ink supply passage for conducting the printing ink produced by the mixing unit to an ink squeegee unit of a printing drum, ink amount sensor for detecting the amount of the printing ink in the ink squeegee unit, and ink supply control unit for controlling the amount of the printing ink that is supplied from the mixing unit to the ink squeegee unit according to the amount of printing ink detected by the ink amount sensor. Thus, a relatively large number of prints can be made with each bottle of printing ink so that the frequency of replacing the ink bottle may be reduced. Additionally, stable stencil printing can be carried out by receiving printing ink having prescribed consistency and other desirable properties irrespective of the age of the printing ink or the surrounding temperature without requiring any human intervention.

8 Claims, 2 Drawing Sheets

STENCIL PRINTING DEVICE HAVING AN INK MIXING UNIT

TECHNICAL FIELD

The present invention relates to a stencil printing device, and in particular to a stencil printing device for carrying out stencil printing by using a printing ink consisting of a mixture of a first liquid and a second liquid.

BACKGROUND OF THE INVENTION

The printing ink used in stencil printing devices in most cases consists of W/O type emulsion ink having an appropriate consistency. Such a printing ink is typically produced in a factory by mixing and emulsifying oil and water containing dye (pigment) by using a mixer, and is commercially available in ink bottles. Since the effective part of the printing ink is limited to the oil component of such an emulsified ink, an bottle of printing ink tends to be consumed by printing a limited number of prints, and it is necessary to replace the ink bottle more often than desired.

It is known that emulsion printing ink tends to undergo some changes in its property and to separate into oil and water in time. Printing ink which has separated into oil and water and is thus made uneven in its properties loses its original consistency (viscosity), and may lose its suitability as printing ink for stencil printing. Therefore, there is a certain service life in the emulsion printing ink packaged in an ink container.

Furthermore, most printing inks for stencil printing such as emulsion inks and oil inks are subjected to changes in their consistency depending on the surrounding temperature, and it is necessary to adjust the contents of the printing ink depending on the season of the year for keeping the consistency or viscosity at an appropriate level irrespective of the surrounding temperature.

BRIEF SUMMARY OF THE INVENTION

In view of such problems of the prior art, a primary object of the present invention is to provide a stencil printing device which allows relatively large number of prints to be made with each bottle of printing ink so that the frequency of replacing the ink bottle may be reduced.

A second object of the present invention is to provide a stencil printing device which allows stable stencil printing to be carried out by receiving printing ink having prescribed consistency and other desirable properties irrespective of the age of the printing ink or the surrounding temperature.

A third object of the present invention is to provide a stencil printing device which allows uniform print results to be achieved at all times without requiring any human intervention.

These and other objects of the present invention can be accomplished by providing a stencil printing device for carrying out stencil printing by using a printing ink consisting of a mixture of a first liquid and a second liquid, comprising: a first liquid storage container for storing the first liquid; a second liquid storage container for storing the second liquid; a mixing unit for receiving the first liquid from the first liquid storage container and the second liquid from the second liquid storage container, and producing printing ink by mixing the two liquids; printing ink supply passage means for conducting the printing ink produced by the mixing unit to an ink squeegee unit of a printing drum for stencil printing; ink amount detecting means for detecting the amount of the printing ink in the ink squeegee unit; and ink supply control means for controlling the amount of the printing ink that is supplied from the mixing unit to the ink squeegee unit according to the amount of printing ink detected by the ink amount detecting means.

According to such a structure, the mixing unit receives the first liquid from the first liquid storage container, and the second liquid from the second liquid storage container, and produces the printing ink by mixing the two liquids. The printing ink is then supplied to the ink squeegee unit of the printing drum for stencil printing. The first liquid storage container typically accommodating an original ink liquid based on an oily substance is disposed inside the cylindrical printing drum for stencil printing while the second liquid typically consists of a water phase component liquid which is adapted to form an emulsified printing ink by being mixed with the original ink liquid. Preferably, the mixing unit is placed in a printing device main body, and the second liquid storage container is located at a position higher than the mixing unit, and communicated with the mixing unit via a control valve controlled by the mixing control means so that a prescribed amount of the water phase component liquid may be supplied to the mixing unit under the action of the gravity.

Thus, a relatively large number of prints can be made from each bottle of printing ink because the water phase component liquid can be refurbished as required. Thus, the frequency of replacing the ink bottle, and hence the possibility of smearing the cloths of the user and the room can be reduced.

The stencil printing device may further comprise recirculation supply passage means for recycling the mixture produced by the mixing unit back to the mixing unit, and the mixing unit may consist of a mixing pump unit which also serves as an ink supply pump for metering the mixture to the ink squeegee unit. Thus, a highly efficient mixing unit can be achieved without increasing the cost or the size.

To the end of attaining a desired consistency and other desired properties, the stencil printing device may further comprise consistency detecting means for detecting a consistency of the printing ink produced by the mixing unit; and mixing control means for controlling the ratio of supply of the first and second liquids according to the consistency of the printing ink detected by the consistency detecting means. The ratio of the first and second liquids supplied to the mixing unit is controlled according to the consistency of the printing ink, and the required amount of printing ink having a prescribed consistency can be prepared immediately before the use and supplied to the ink squeegee unit irrespective of the surrounding temperature. The consistency of the printing ink can be conveniently detected by measuring a load of drive means actuating the mixing unit.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
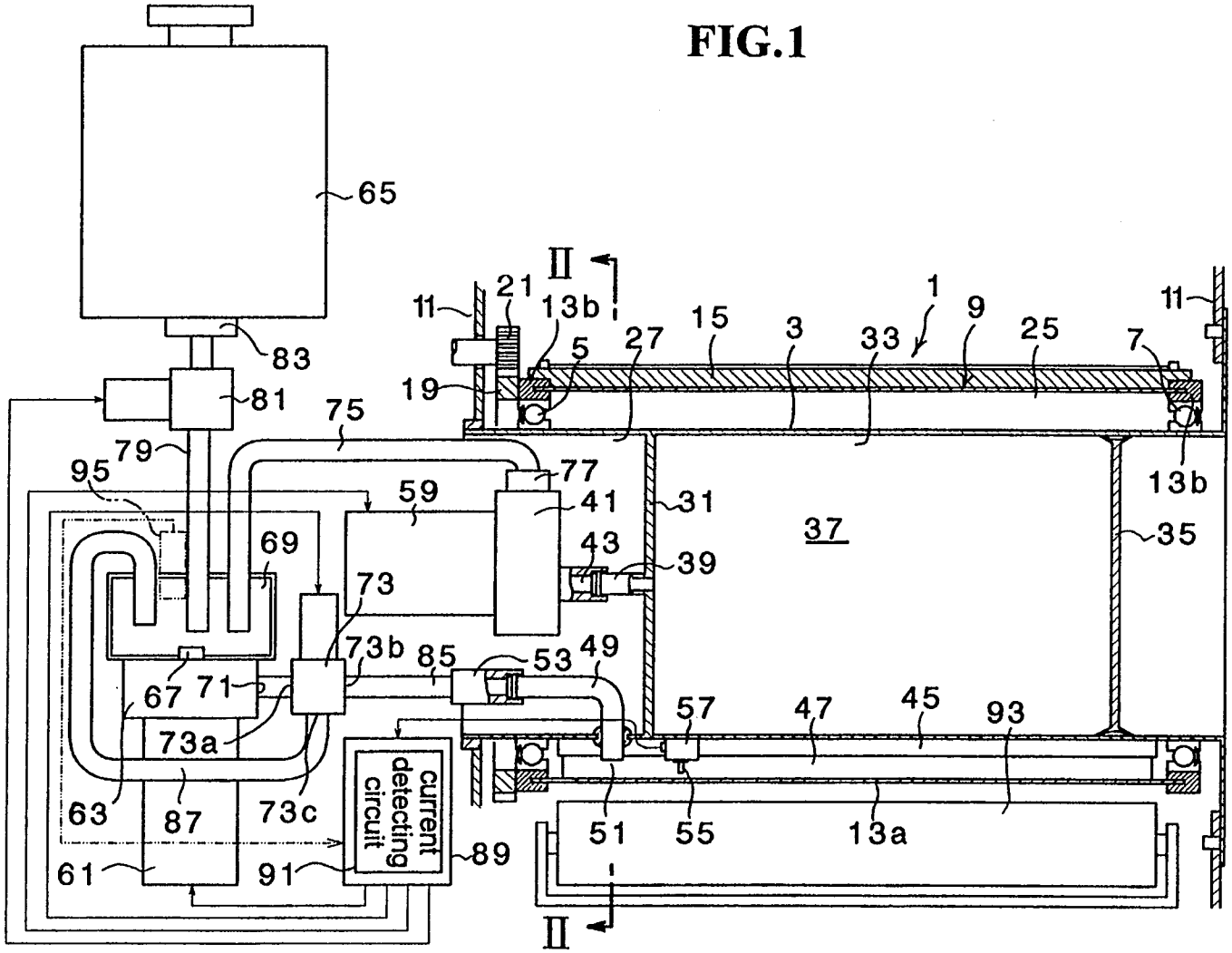
FIG. 1 is a schematic overall structural view of an essential part of an embodiment of the stencil printing device according to the present invention.
Figure 2:
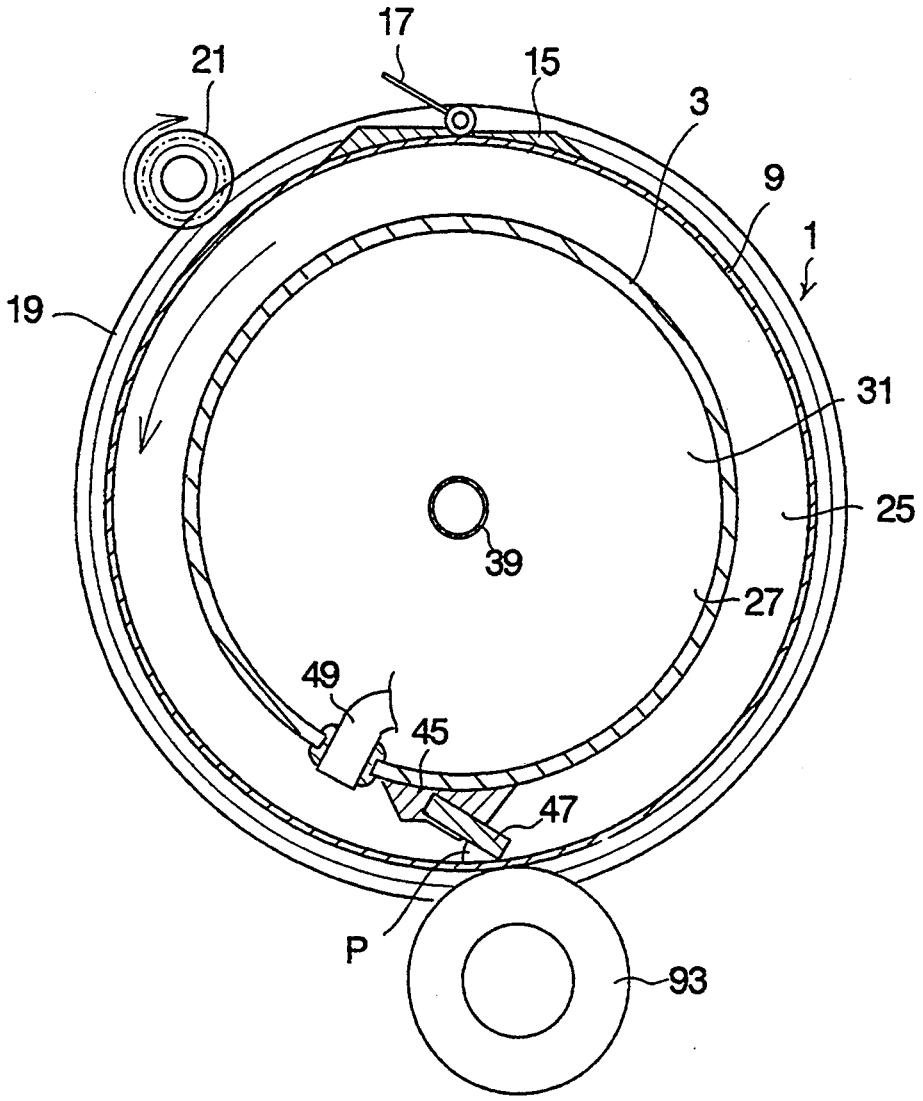
FIG. 2 is a sectional view taken along line II—II of FIG. 1.

FIGS. 1 and 2 illustrate an embodiment of the stencil printing device according to the present invention. In these drawings, numeral 1 generally denotes a printing drum for stencil printing. The printing drum 1 comprises a fixed hollow cylindrical member 3, and a printing drum main body 9 which is coaxially disposed around the fixed cylindrical member 3 and rotatably supported by the fixed cylindrical member 3 via a pair of roller bearings 5 and 7 at its two axial ends, and is thus supported at two axial ends by the fixed cylindrical member 3 which is in turn detachable from a fixed frame 11 forming a part of a printing device main body. In other words, the hollow cylindrical member 3 is fixedly secured to the fixed frame 11, and rotatably supports the cylindrical printing drum main body 9 much like a hollow shaft.

The printing drum main body 9 consists of a thin-shell cylindrical member 13*a*, and a pair of annular end support rings 13*b* engaging the two axial ends of the cylindrical member 13*a*, and are rotatably supported at both its axial ends by the roller bearings 5 and 7 via the end support rings 13*b*.

The printing drum main body 9 is provided with an master plate sheet clamp 17 on its platform portion 15 fixedly secured on its outer circumferential surface so that a stencil master plate sheet may be mounted on the outer circumferential surface of the printing drum main body 9 with a leading edge of the stencil master plate sheet clamped by the master plate sheet clamp 17. The outer circumferential surface of the cylindrical member 13*a*, except for the region of the master plate sheet clamp 17 and its vicinity, is formed as an ink permeable portions by forming it into a fine porous structure by electroforming or the like.

A ring gear 19 is fixedly mounted on one of the end support rings 13*b* in coaxial relationship to the cylindrical member 13*a*, and a drive gear 21 meshes with the ring gear 19. The drive gear 21 is actuated in clockwise direction as seen in FIG. 2 by a printing drum drive motor not shown in the drawings which is fixedly arranged in the stencil printing device main body, and the printing drum 9 is rotated in counter clockwise direction around its central axial line.

A relatively narrow annular gap 25 is defined between the outer surface of the hollow cylindrical member 3 and the printing drum main body 9, and a cylindrical chamber 27 having two open axial ends is defined inside the hollow cylindrical member 3. The cylindrical chamber 27 is separated from the annular gap 25 by the hollow cylindrical member 3.

The cylindrical chamber 27 consists of a relatively large chamber having a large diameter determined by the diameter of the hollow cylindrical member 3, and this cylindrical chamber 27 is laterally separated into two chambers by an internal partition wall 31 as seen in FIG. 1, the right chamber being defined as an original ink liquid storage container portion 33. The original ink storage container 33 receives a piston member 35 in an axially slidable manner, thereby defining an original ink liquid storage container chamber 37 between the piston member 35 and the internal partition wall 31. The original ink liquid storage container chamber 37 accommodates therein an original ink liquid, or an oil phase component of emulsion ink for stencil printing. The original ink liquid may contain a dye, an emulsifier and so on in its oily medium.

The internal partition wall 31 is provided with an original ink liquid outlet 39, onto which a suction port 43 of an original ink liquid delivery pump 41 is fitted in a detachable manner.

A squeegee blade mounting portion 45 is provided on a lower part of the outer circumferential part of the hollow cylindrical member 3, and a squeegee blade 47 is mounted on the squeegee blade mounting portion 45. The squeegee blade 47 is located in the annular gap 25 which is small enough to barely accommodate only the squeegee blade 47.

The squeegee blade 47 is made of rubber or rubber-like material, and engages the inner circumferential surface of the cylindrical member 13*a* of the printing drum main body 9 at a prescribed squeegee angle and a prescribed squeegee pressure.

An ink supply pipe 49 is fixedly arranged in the cylindrical chamber 27. The ink supply pipe 49 passes through the wall of the cylindrical member 3, and extends into the annular gap 25. The terminal end of the ink supply pipe 49 located in the annular gap 25 defines an ink outlet 51, and the other end of the ink supply pipe 49 fits into an ink supply port 53 fixedly arranged in the stencil printing device main body.

The ink outlet 51 of the ink supply pipe 49 is fixedly placed so as to trail the squeegee blade 47 by a small distance, and feeds printing ink to a region trailing the point of contact between the cylindrical member 13*a* and the squeegee blade 47. The printing ink in this region forms a small ink reservoir P.

The hollow cylindrical member 3 is provided with an ink amount sensor 57 for detecting the amount of the printing ink in the ink reservoir P with an ink amount detecting needle according to an electrostatic principle.

The stencil printing device main body includes the original ink liquid delivery pump 41, the electric motor 59 for actuating the original ink liquid delivery pump 41, the mixing unit 63 actuated by the motor 61, and a water tank 65 all in a fixed arrangement. The water phase component for the emulsion ink for stencil printing stored in the water tank 65 may contain a surface reactant and a moisturizing agent.

The mixing unit 63 may consist of an emulsifying unit of a type incorporating a pump of a gear, screw or other type, and includes a suction port 67 which is directly connected to a mixing reservoir 69 in liquid communication, and an ejection port 71 connected to one of ports 73*a* of a solenoid flow passage switching valve 73 in liquid communication.

The mixing reservoir 69 consists of an ink buffer of a small capacity corresponding to the amount of printing ink for each cycle, and is connected to an ejection port 77 of the original ink liquid delivery pump 41 via the original ink liquid supply pump 75 to be metered by the original ink liquid delivery pump 41.

The mixing reservoir 69 is also connected to a water supply control valve 81 via a water supply pipe 79, and the water supply control valve 81 is in turn connected to an outlet port 83 of the water tank 65. Thus, by virtue of this communication structure, the water phase component liquid from the water tank 65 is metered to the mixing reservoir 69 by the water supply control valve 81 under the action of the gravity.

The water supply control valve 81 may be electromagnetically actuated, and may consist of either a flow control valve which is capable of variably changing its opening area or an on-off valve which is capable of variably changing the opening time period.

One of the two remaining ports 73*b* of the solenoid flow passage switching valve 73 is directly connected to the ink supply port 53 via an ink supply pipe 85, and the remaining port 73*c* is connected to the mixing reservoir 69 via the recirculation pipe 87.

The ink amount sensor 57 is connected to a control unit 89 via a signal line, and supplies an ink amount detection signal to the control unit 89. The control unit 89 comprises a microcomputer embodying ink production and supply control means, and includes, as an internal circuit, current detecting circuit 91 for detecting the electric current supplied to the motor 61 as an indication of the load of the motor 61. The control unit 61 controls the motors 59 and 61 as well as the operation of the solenoid flow passage switching valve 73 and the water supply control valve 81 in dependence on the amount of printing ink detected by the ink amount sensor 57 and the electric current detected by the current detecting circuit 91 according to a prescribed program, and controls the amounts of the original ink liquid and the water phase component, their mixing ratio, and the amount of the printing ink supplied to the ink squeegee unit or the ink reservoir P so that an emulsion ink of a desired consistency may be obtained.

A press roller 93 is provided under the printing drum 1 for stencil printing, and printing paper is fed from left to right as seen in FIG. 2 between the printing drum 1 and the press roller 93 in synchronism with the rotation of the printing drum 1 by a known paper feeding unit not shown in the drawings. A desired stencil printing is thus carried out by pressing the printing paper against the stencil master plate sheet mounted on the printing drum 1 with the press roller 93.

According to such a structure, before starting the printing, first of all, the motor 59 is activated, and the original ink liquid in the original ink liquid storage chamber 37 is metered to the mixing reservoir 69 by the original ink liquid delivery pump 41 via the original ink liquid supply pipe 75 while the water phase component liquid from the water tank is likewise metered to the mixing reservoir 69 by the water supply control valve 81 via the water supply pipe 79. The ratio of the original ink liquid and the water phase component liquid is quantitatively controlled by the time duration of the operation of the motor 59 and the opening area or the opening time period of the water supply control valve 81. This supply ratio may consist of an initially predetermined standard supply ratio.

Once the original ink liquid and the water phase component liquid are supplied to the mixing reservoir 69, the motor 61 starts actuating the mixing unit 63 which draws the original ink liquid and the water phase component liquid from the mixing reservoir 69, and mixes and emulsifies them before finally ejecting it to the solenoid flow passage switching valve 73.

At this time point, because the solenoid flow passage switching valve 73 communicates the port 73*a* to the port 73*c*, the mixture expelled from the mixing unit 63 is returned to the mixing reservoir 69 via the recirculation pipe 87, and is resupplied to the mixing unit 63. The mixing unit 63 thus produces the emulsion ink (printing ink) by mixing and recirculating the original ink liquid and the water phase component liquid.

The mixing operation of the mixing unit 69 is stopped when the electric current detected by the electric current detecting circuit 91 or the load of the motor 61 actuating the mixing unit has reached the prescribed level indicative of the attainment of a prescribed consistency by the mixture (emulsion ink) in the mixing unit 63.

If the printing ink fails to attain the prescribed level of consistency after the mixing operation has been continued for more than a prescribed time period, the original ink liquid or the water phase component liquid is added to the mixing reservoir so that the supply ratio of the original ink liquid and the water phase component liquid may be appropriately corrected.

When the amount of the printing ink in the ink reservoir P detected by the ink amount sensor 57 falls below a prescribed limit, the port 73*a* of the solenoid flow passage switching valve 73 is communicated with the port 73*b* while the motor 61 starts actuating the mixing unit 63. As a result, the mixing unit 63 operates as a printing ink supplying pump, and the emulsion ink prepared in the mixing reservoir 69 to a prescribed consistency is supplied to the ink reservoir P via the ink supply pipe 49.

When the amount of the printing ink in the ink reservoir P as detected by the ink amount sensor 57 exceeds a prescribed level as a result of such a process of supplying printing ink, the printing ink is stopped from being supplied any further, and the original ink liquid and the water phase component liquid are supplied to the mixing reservoir 69 at the standard supply ratio and by an amount corresponding to the amount of the printing ink consumed during the above mentioned process of supplying printing ink or the reduction in the amount of the printing ink in the mixing reservoir 69. The mixing unit 63 then produces the emulsion ink having the prescribed consistency by recirculation. The refurbishing of the emulsion ink in the mixing reservoir 69 is carried out in this manner.

If the emulsion ink of the prescribed consistency cannot be obtained even when the mixture is mixed for more than the prescribed time period, the original ink liquid or the water phase component liquid is added to the mixing reservoir 69 to adjust the supply ratio of the original ink liquid and the water phase component liquid.

If the emulsion ink in the mixing reservoir 69 is not consumed for more than a prescribed time period after completion of the mixing process, the mixing unit 63 is actuated to determine the consistency of the emulsion ink according to the actuation load, and upon detection of a substantial drop in the consistency of the emulsion ink, the mixing unit 63 is operated until the desired consistency is attained.

Thus, emulsion ink of a suitable consistency can be produced on the on-demand basis according to the consumption of the printing ink in the ink squeegee unit, and suitable printing ink having an appropriate consistency can be supplied to the ink reservoir P at all times.

If there is any emulsion ink left in the ink reservoir P upon completion of a printing process, the mixing unit 63 may be actuated in reverse direction by the motor 61 so that the excess emulsion ink in the ink reservoir P may be drawn by the mixing unit 63 via the ink supply pipe 49 to return it to the mixing reservoir 69, and this emulsion ink may be mixed by the mixing unit 63 until the desired consistency is attained when resuming the operation of the stencil printing device.

Because the original ink liquid is stored in the original ink liquid storage chamber 37 instead of the emulsion ink, the possible number of prints for a given amount of printing ink can be significantly increased as compared to the case of storing the emulsion ink.

The original ink liquid storage chamber 37 was provided inside the printing drum in the above described embodiment while the water tank 65 was provided in the printing device main body, but the present invention is not limited by this embodiment, and the original ink liquid storage chamber 37 may also be located in the printing device main body while the water tank is provided inside the printing drum. Also, the original ink liquid storage chamber 37 and the water tank may be both located in the printing device main body or the printing drum. The original ink liquid storage chamber 37 and the water tank 65, when they are to be installed inside the printing drum, may consist of refill or throw-away removable bottles.

In the above described embodiment, the mixing operation of the mixing unit 63 was controlled according to the amount of the printing ink in the ink squeegee unit as detected by the ink amount sensor 57, but may also be controlled according to the amount of the printing ink in the mixing reservoir 69. In this case, the ink amount sensor 95 may be provided in the mixing reservoir 69.

Alternatively, the stencil printing device may be constructed in such a manner that the original ink liquid storage chamber 37 accommodates original emulsion ink having a relatively low water content, and the water phase component liquid from the water tank 65 is added to it to produce and supply emulsion ink having the prescribed consistency. It is also possible to add an oil component to oil ink to adjust its consistency, and the stencil printing device may also be constructed so as to use two-liquid reaction type printing ink. The mixing unit may be of a suitable type depending on the kind of the printing ink that is to be mixed and produced in the mixing unit.

As can be understood from the above description, according to the stencil printing device of the present invention, because the printing ink is mixed and produced in the mixing unit provided in the stencil printing device, and supplied to the ink squeegee unit, it is possible to produce a required amount of printing ink in the mixing unit according to the consumption of the printing ink in the ink squeegee unit immediately before use, and the operation of the mixing unit and the supply ratio of the first liquid and the second liquid to the mixing unit can be controlled according to the consistency of the printing ink. Thus, because the required amount of printing ink having a prescribed consistency can be produced immediately before use without regard to the surrounding temperature, and supplied to the ink squeegee unit at all times, a stable stencil printing can be always accomplished by using printing ink having a prescribed consistency and other prescribed properties.

In the case of the emulsion ink, because the water phase component liquid is added to the original ink liquid by the ratio of approximately 3 to 7 to prepare the emulsion ink, the amount of the emulsion ink made available from one bottle of original ink liquid is substantially increased by addition of the water phase component liquid, and a large number of prints can be made simply by adding a required amount of the water phase component liquid. Thus, the frequency of handling the printing ink by the user or the service personnel can be reduced, and the possibility of smearing the clothing and the room can be reduced.

Although the present invention has been described in terms of a specific embodiment thereof, it is possible to modify and alter details thereof without departing from the spirit of the present invention.

What we claim is:

1. A stencil printing device for carrying out stencil printing by using a printing ink consisting of a mixture of a first liquid and a second liquid, comprising:

a first liquid storage container for storing said first liquid;

a second liquid storage container for storing said second liquid;

a mixing unit for receiving said first liquid from said first liquid storage container and said second liquid from said second liquid storage container, and producing printing ink by mixing said two liquids;

a cylindrical printing drum for stencil printing having an ink squeegee unit;

printing ink supply passage means for conducting said printing ink produced by said mixing unit to said ink squeegee unit of said printing drum;

ink amount detecting means for detecting the amount of the printing ink in said ink squeegee unit; and ink supply control means for controlling the amount of the printing ink that is supplied from said mixing unit to said ink squeegee unit according to the amount of printing ink detected by said ink amount detecting means.

2. A stencil printing device according to claim 1, further comprising recirculation supply passage means for recycling said mixture produced by said mixing unit back to said mixing unit.

3. A stencil printing device according to claim 1, wherein said mixing unit consists of a mixing pump unit which also serves as an ink supply pump for metering said mixture to said ink squeegee unit.

4. A stencil printing device according to claim 1, further comprising:

consistency detecting means for detecting a consistency of the printing ink produced by said mixing unit; and mixing control means for controlling the ratio of supply of said first and second liquids according to said consistency of the printing ink detected by said consistency detecting means.

5. A stencil printing device according to claim 4, wherein said consistency detecting means detects the consistency of the printing ink in said mixing unit according to a load of drive means actuating said mixing unit.

6. A stencil printing device according to claim 1, wherein said first liquid storage container is disposed inside said cylindrical printing drum for stencil printing while said mixing unit is placed in a printing device main body.

7. A stencil printing device according to claim 6, wherein said first liquid consists of an original ink liquid based on an oily substance, and said second liquid consists of a water phase component liquid which is adapted to form an emulsified printing ink by being mixed with said original ink liquid.

8. A stencil printing device according to claim 7, including a control valve wherein said second liquid storage container consists of a water tank located at a position higher than said mixing unit, and is communicated with said mixing unit via said control valve controlled by said mixing control means so that a prescribed amount of said water phase component liquid may be supplied to said mixing unit under the action of the gravity.

* * * * *